US006959714B1

(12) United States Patent
Håkansson et al.

(10) Patent No.: US 6,959,714 B1
(45) Date of Patent: Nov. 1, 2005

(54) DEVICE AND METHOD FOR A WASHING SYSTEM

(75) Inventors: Paul Håkansson, Växjö (SE); Roland Karlsson, Växjö (SE)

(73) Assignee: Getinge Disinfection AB, Växjö (SE)

( * ) Notice: Subject to any disclaimer, the term of this patent is extended or adjusted under 35 U.S.C. 154(b) by 410 days.

(21) Appl. No.: 10/110,469

(22) PCT Filed: Oct. 27, 2000

(86) PCT No.: PCT/SE00/02094

§ 371 (c)(1),
(2), (4) Date: Apr. 12, 2002

(87) PCT Pub. No.: WO01/34015

PCT Pub. Date: May 17, 2001

(30) Foreign Application Priority Data

Nov. 9, 1999 (SE) ..... 9904054

(51) Int. Cl.[7] ..... B08B 9/20

(52) U.S. Cl. ..... 134/25.2; 134/57 D; 134/85; 134/133; 134/165; 134/200

(58) Field of Search ..... 134/25.2, 25.3, 134/57 D, 56 D, 58 D, 61, 66, 82–85, 133, 134/137, 140, 165, 200, 201

(56) References Cited

U.S. PATENT DOCUMENTS

| | | | | |
|---|---|---|---|---|
| 2,947,311 | A * | 8/1960 | Fox et al. | 134/58 D |
| 3,221,754 | A * | 12/1965 | Robson et al. | 134/68 |
| 4,274,886 | A * | 6/1981 | Noren | 134/25.2 |
| 4,313,451 | A * | 2/1982 | Vilen | 134/47 |
| 4,357,176 | A | 11/1982 | Anthony | |
| 4,676,365 | A * | 6/1987 | Noren | 198/803.14 |
| 5,218,980 | A * | 6/1993 | Evans | 134/68 |
| 5,329,952 | A | 7/1994 | Kojima et al. | |
| 5,904,162 | A * | 5/1999 | Ferguson et al. | 134/25.2 |
| 6,530,996 | B2 * | 3/2003 | Varpio | 134/18 |

FOREIGN PATENT DOCUMENTS

| | | |
|---|---|---|
| DE | 41 13 086 A1 | 10/1992 |
| DE | 195 13 994 A1 | 10/1996 |
| DE | 196 29 325 A1 | 1/1998 |
| JP | 4-193152 | 7/1992 |

* cited by examiner

*Primary Examiner*—Joseph L Perrin
(74) *Attorney, Agent, or Firm*—Buchanan Ingersoll PC

(57) ABSTRACT

The present invention relates to a loading system in a washing installation comprising a plurality of dishwashers arranged essentially in parallel. The loading system comprises a dish holder to be loaded with goods to be washed, and a traveller which is adapted to convey the dish holder to a selected dishwasher, into which loading is to take place, the traveller being displaceably arranged along the dishwashers arranged in parallel. The invention also relates to a washing installation and a method therefor. The installation comprises a plurality of essentially parallel dishwashers of a straight-way type, which are essentially built into a separating wall portion to form an inlet side and an outlet side. The installation has two mutually independent loading systems for loading of goods to be washed on the inlet side and unloading of washed goods on the outlet side.

23 Claims, 3 Drawing Sheets

DEVICE AND METHOD FOR A WASHING SYSTEM

FIELD OF THE INVENTION

The present invention relates to a loading system in a washing installation, which comprises a plurality of dishwashers arranged essentially in parallel. More-over, the invention relates to a washing installation which comprises a plurality of dishwashers arranged in parallel, which are of a straightway type and essentially built into a wall portion to form an inlet side and an outlet side. The invention also relates to a method for loading washing installations of the above type.

BACKGROUND ART

Washing installations of the type mentioned above, i.e. washing devices with dishwashers arranged in parallel, have been known for a long time. However, the known constructions suffer from a number of drawbacks. Either the dishwashers must be loaded manually, which is time- and labour-consuming. Moreover staff is required to monitor when the dishwashers have finished, which dishwashers are free etc, which makes this system very inefficient. Experiments with automatic loading systems for this type of installation have been made, but such systems have been very bulky and impractical. As an example, a construction can be mentioned in which the dishwashers are loaded by means of roller conveyors which are arranged in the feeding direction of the dishwashers, in front of and behind each dishwasher. This construction is not only bulky but also makes access to the dishwashers in case of service difficult. Furthermore the roller conveyors, and the floor surface therebelow, are difficult to keep clean, which has a detrimental effect on the hygienic standard of the installation. Separate roller conveyors also require staff to distribute the goods to be washed among the different dishwashers. An advantage of this type of installation with parallel dishwashers, however, is that the remaining dishwashers can be used even if one or more dishwashers need to be serviced or the like.

Most washing installations on the market, however, are of a so-called indexing type, meaning that a dishcarrying trolley is run through a plurality of washing compartments arranged in series. These systems have a number of drawbacks in common. First, the systems are connected in series and in many cases they have a common control for washing and transport. If one part of the installation is put out of service, thus the entire installation comes to a standstill with a capacity loss of 100%. Second, connecting in series means that the consumption of time for each step in the process must be adjusted to the step that requires the largest amount of time, i.e. some fast working processes will stand still for a great part of the time. Finally, the indexing systems have in most cases a covered design, which renders visual monitoring of the washing process as well as service and maintenance difficult. In these respects, parallel systems are preferred, but the previously known systems have the drawbacks mentioned above. Particularly serious problems arise, for example, in washing installations in hospitals, where a clean and hygienic environment is an absolute requirement, and where great demands are placed on washing capacity and operational reliability.

OBJECTS OF THE INVENTION

One object of the present invention thus is to provide a washing installation with dishwashers arranged in parallel, having a loading system which allows easy access to the dishwashers for maintenance/service of parts of the installation, without ensuing great capacity troubles. Additional objects of the invention are to provide an installation which is hygienic and easy to keep clean and which allows a high washing capacity.

SUMMARY OF THE INVENTION

These and other objects are achieved by a loading device of the type mentioned by way of introduction, which is further characterised in that the loading system comprises a dish holder to be loaded with goods to be washed, and a traveller which is adapted to convey said dish holder to a selected dishwasher, into which loading is to take place, said traveller being displaceably arranged along said dishwashers arranged in parallel. The system thus has a common loading device for a row of dishwashers, which allows automatic selection of a suitable dishwasher. Moreover dish holders are transported by means of a movable traveller, which thus allows a free floor space, in contrast to stationary conveyors, and allows easy access to a dishwasher in connection with, for instance, service.

Moreover, the loading system suitably comprises a storage place for intermediate storage of loaded dish holders.

Conveniently the system comprises at least one loading place for loading goods to be washed into dish holders included in said washing installation and unloading of washed goods from said dish holders.

According to a preferred embodiment, the traveller is pendular-suspended from the travelling track, the traveller in its lower part resting against a supporting track extending below said dishwashers arranged in parallel. It is possible to let the entire weight of the traveller be supported by a wall portion defined by the row of dishwashers. As a result, the traveller can go completely free of the floor of the installation, which allows a free floor space and renders cleaning thereof easy.

Conveniently the traveller is displaceable in a direction essentially perpendicular to the feeding direction of the dishwashers, which allows the traveller to be arranged very close to the wall portion defined by the row of dishwashers, and to follow the wall portion. The extent of the device in space thus is small.

Moreover, the traveller is suitably movable between a first position, in which the dish holder in question is transferable between the traveller and the storage place, and a number of feeding positions which are located in connection with the inlet/outlet of the respective dishwashers and in which the dish holder is transferable between the traveller and the washing space of the respective dishwashers, a dish holder arranged on the traveller being stationary relative to the traveller while the traveller moves between the first position and one of the feeding positions.

Furthermore the storage place is suitably adapted for intermediate storage of dish holders which are oriented in advance in the same direction as in a washing operation, which facilitates feeding. Furthermore the storage place comprises a belt conveyor extending in the feeding direction and adapted to successively convey dish holders, essentially between the loading place and the traveller, and constitutes an intermediate storage for loaded trolleys waiting for washing or unloading. This enables higher efficiency, for example, since a number of trolleys can be loaded simultaneously, whereupon the responsible staff is free to perform other work, and the trolleys are automatically loaded into a dishwasher for washing as soon as there is a free dishwasher, which also improves the flow in the installation.

Further advantageous embodiments of the loading device are recited in the subclaims.

The above objects are also achieved by a washing installation which is of the type defined by way of introduction and which is characterised in that it comprises two mutually independent loading systems of the type described above for loading of goods to be washed on the inlet side and unloading of washed goods on the outlet side. This also enables a system operating fully automatically from loading of goods until unloading of goods. This will set staff free for other tasks.

According to a preferred embodiment, the washing installation comprises a return conveyor travelling from the outlet side to the inlet side to easily return the dish holders to the inlet side where they can be used again and be loaded with new goods to be washed.

Suitably the loading system on the inlet side, the unloading system on the outlet side and the dishwashers are controlled separately from each other by means of independent control units and comprise mechanical sensors for synchronising between the three subsystems, said sensors being electrically connected to the respective control units. This independent control means that even if, for example, the loading system on the inlet side is being serviced, dish holders can be fed manually into the dishwashers, whereupon the automatic unloading system on the outlet side functions as usual and handles the outgoing dish holders in the usual manner. This is also applicable when servicing a dishwasher. The systems then use the remaining dishwashers and load them as usual. The mechanical connecting means allow, for example, simple manual loading of the dishwashers as an alternative to the automatic loading.

Finally, the above objects are also achieved by a method as defined in claim 18.

BRIEF DESCRIPTION OF THE DRAWINGS

The invention will be described below in more detail with reference to preferred embodiments as illustrated in the accompanying drawings, in which.

DESCRIPTION OF PREFERRED EMBODIMENTS

Figure 1:
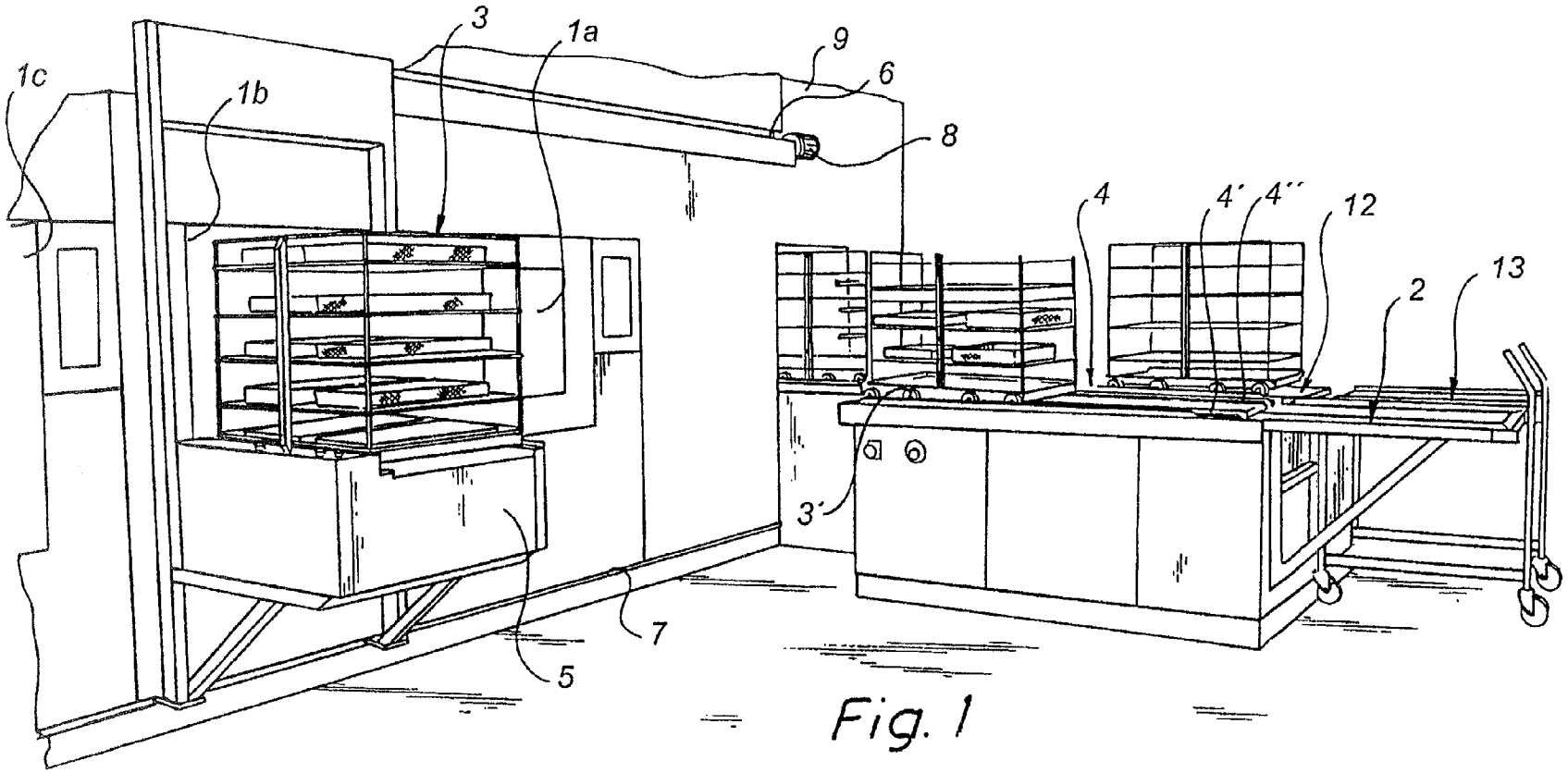
FIG. 1 is a perspective view of a loading system according to the invention, included in a washing installation.

FIG. 1 shows a loading system included in a washing installation for hospitals also comprising a number of juxtaposed dishwashers arranged in parallel, in this case of the type DECOMAT A-8666, which are made and sold by Getinge Disinfection AB, and a conveyor 12 for dish holders 3 included in the system, said conveyor being described in more detail below.

The loading system comprises a loading place 2, here a loading table, in this case located in immediate connection with a storage place 4. The storage place 4 shown in FIG. 1 comprises a table portion having a tub-like portion with an outlet device, for easy cleaning of said table portion. Belt conveyors 4', 4" are arranged on opposite sides of the table portion. Moreover the loading system comprises a traveller 5 which is supported in a travelling track 6 which extends over the row of dishwashers (1*a*–1*c*). The traveller is practically seen pendular-suspended from this travelling track 6 and abuts against a supporting track 7 in which the traveller 5 in its lower part is displaceably arranged. To perform said displacement motion, the portion of the traveller 5 which is arranged in the travelling track 6 communicates with a motor 8, which by means of a belt drive carries out the displacement. In this case, the travelling track 6 is arranged in a beam having an upwardly directed guide rail which is defined by the beam and from which the traveller 5 is suspended. The beam is conveniently fixedly connected with the floor of the installation by means of a beam construction. The traveller 5 has a loading surface for loading and transporting a trolley and also has a driving means 15 arranged adjacent to the loading surface. The driving means 15 has a hook portion and a pressing portion for pulling and respectively pressing or pushing a dish holder from one position to another. The traveller 5 has a number of displacement positions between which it is displaceably arranged by means of said tracks and motor unit, viz. a first position in which the traveller 5 is located edge-to-edge with the storage place 4, for easy transfer of dish holders 3 therebetween, and a number of feeding positions in which the traveller 5 is positioned in front of one of the dishwashers 1*a*–1*c* for feeding a dish holder 3 between the dishwasher in question and the traveller 5.

Figure 3:
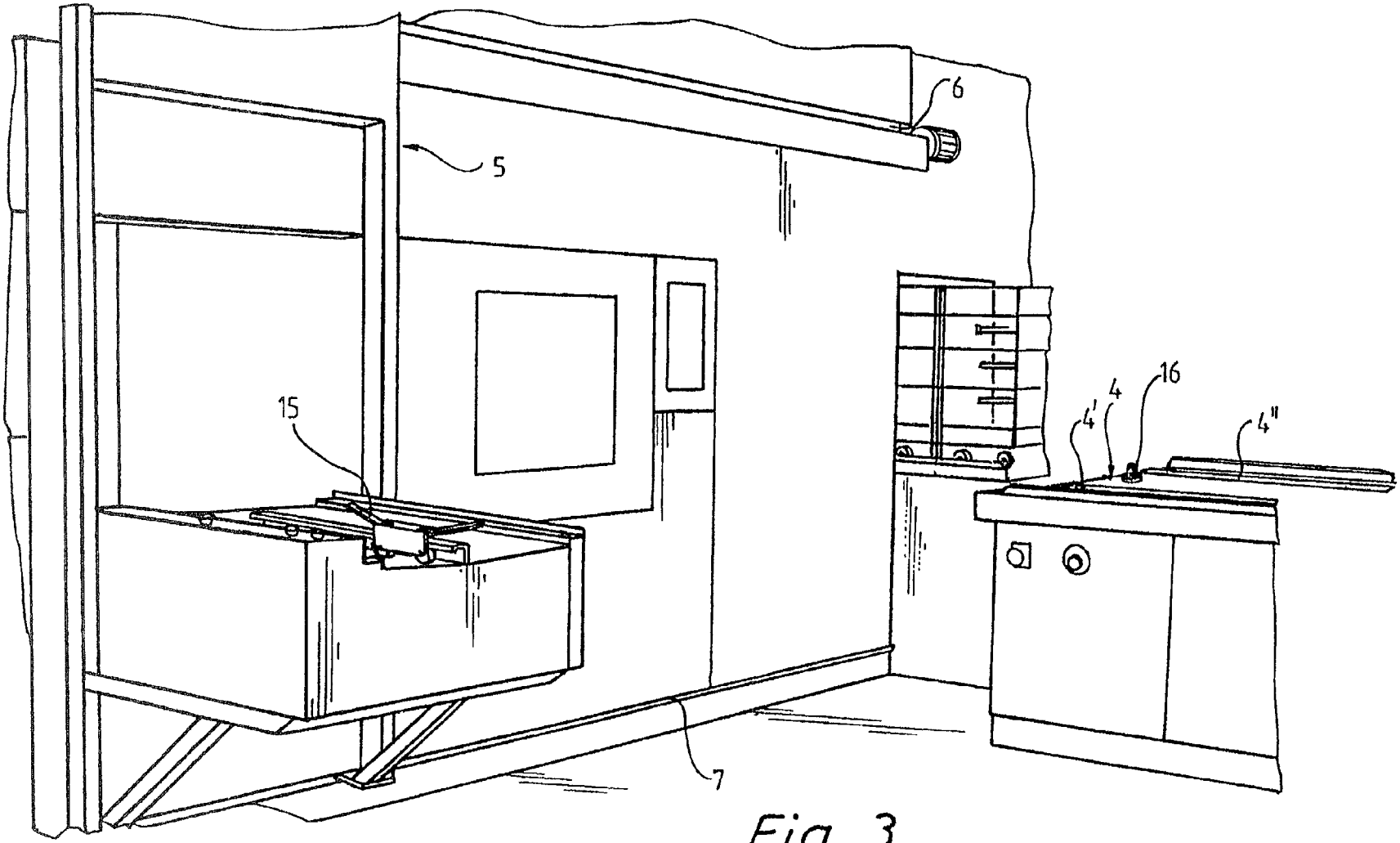
FIG. 3 is a perspective view of a detail of the loading system according to FIG. 1 included in the washing installation.

When loading a dish holder with goods to be washed by means of the loading system described above, an empty dish holder is placed in the loading place 2, here a loading table, whereupon goods to be washed are arranged in a suitable fashion on the dish holder 3. It is also conceivable to arrange the goods to be washed on the dish holder 3 in a loading place 2 separated from the rest of the system, whereupon the loaded dish holder 3 is moved to the position of the shown loading table 2, for instance by means of a trolley 13 included in the washing installation. After loading goods to be washed on to the dish holder 3, the dish holder is moved to the storage place 4, which movement is facilitated by means of rows of wheel elements 3' which are arranged on opposite sides of the dish holder and whose mutual distance between the rows essentially corresponds to the distance between the belt conveyors 4', 4". The dish holder 3 is thus made to roll to the position where the wheels 3' operatively engage said belt conveyors 4', 4", whereupon the conveyors 4', 4" convey the dish holder to a storage position in said storage place 4. This storage position arises when the dish holder 3 abuts against a stop means 16 (see FIG. 3) or an anteriorly situated trolley stored in the storage place 4, whereupon the wheel elements 3' are made to roll freely, or alternatively, an additional motion of the belt conveyors 4', 4' is stopped, thereby preventing unnecessary wear on the belt conveyors 4', 4" and the wheel elements 3'. As anteriorly situated dish holders, if any, are passed on in the system (according to the principle described below), the dish holder 3 is advanced to said stop means 16. The traveller 5 is passed to its first position described above, the traveller being displaced in a direction which is essentially perpendicular to the travelling direction of the belt conveyors 4', 4". The traveller is then arranged edge-to-edge with the storage place 4, adjacent to said stop means 16, the stop means 16 being released and the belt conveyors 4', 4" once more being operatively engaged with the dish holder 3, which is transferred to said traveller 5. Furthermore, also the driving means 15 (see FIG. 3) on the traveller can be made to engage said holder 3 for pulling the same from the storage place 4 to the traveller 5. If the traveller is already in its first position when the dish holder 3 is transferred from the loading place 2 to the storage place 4, and no other dish holders are positioned in the storage place 4, the dish holder 3 can, of course, be transferred directly to the traveller 5 without being stopped by said stop means 16. When the dish holder 3 is correctly arranged on the traveller 5, the traveller is made to be displaced along said travelling track 6 and supporting track 7 by means of a driving device (not shown) arranged in the travelling track 6 and driven by a motor unit 8. The driving device can be designed in various ways, such as in the form of belts or gear rims, and its design is not essential to the invention and will therefore not be discussed in more detail. The traveller 5 travels along said tracks 6, 7 to one of the feeding positions, in which the traveller 5 stops and in which the dish holder 3 is immediately transferable with the aid of the driving means 15 to a dishwasher included in the washing installation, in a direction essentially perpendicular to the travelling direction of the traveller 5.

Similarly, the loading device can be used when unloading washed goods from the dishwashers. An outlet traveller 5 is moved to the outlet of the dishwasher in question, whereupon a dish holder is transferable from the dishwasher to the outlet traveller 5*a* with the aid of corresponding driving means. After the transfer, the outlet traveller 5*a* is moved to its first position, whereupon the dish holder 3, with the aid of the driving means and/or corresponding belt conveyors, is transferred to a storage place 4*a*. In a manner corresponding to that described above, the dish holder 3 is successively advanced to a position where it abuts against a stop means. When the stop means is released, the dish holder is advanced to an unloading place 2*a*, whereupon the washed goods are unloaded from the dish holder 3 and the washing operation is terminated.

Figure 2:
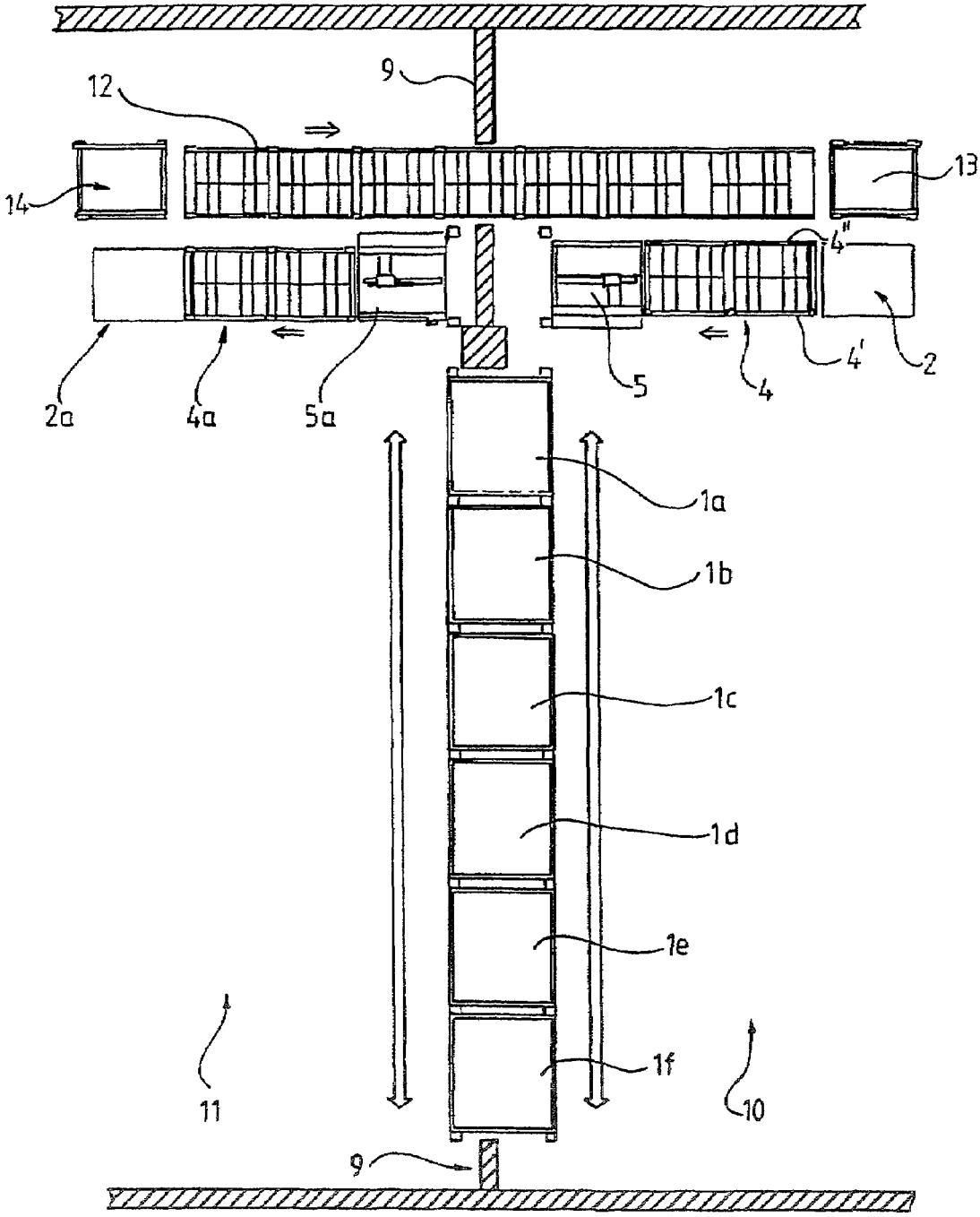
FIG. 2 is a schematic top plan view of the entire washing installation mentioned in connection with FIG. 1.

FIG. 2 is a schematic view of a washing installation comprising a number of dishwashers 1*a*–1*f* arranged in parallel, a loading device as described above, an unloading device as described above and a return conveyor 12. Furthermore the system comprises trolleys 13, 14 on the loading as well as the unloading side, which are adapted to easily transfer dish holders 13 between the trolleys 13, 14 and the return conveyor 12 and the loading places 2, 2*a*, respectively. The dishwashers 1*a*-If are built into a wall portion 9 to form an inlet side 10 for goods to be washed and an outlet side 11 for washed goods. The return conveyor 12 travels through an opening in the wall 9 to return trolleys from the outlet side 11 to the inlet side 10. For hygienic reasons, the two sides are besides well separated from each other. The possibility of this complete separation of the two sides is most important in, for example, medical care, thus preventing transmission of infections and the like. The dishwashers in the system shown in FIG. 2 are of the above-mentioned type DECOMAT A-8666, which are manufactured and sold by Getinge Disinfection AB, but of course other dishwashers can be used as well. The dishwashers 1*a*–1*f* are of a straightway type, i.e. goods to be washed are supplied through an inlet, whereupon they are washed and discharged through an outlet, which is positioned on a side of the dishwasher opposite to said inlet.

A dish holder 3 is loaded with goods to be washed, whereupon it is are conveyed by means of the above-described conveying device to an input position in front of a dishwasher, in which position the holder is arranged on the traveller. Subsequently, the dish holder is loaded into the dishwasher with the aid of the driving means 15, which in this example comprises cooperating spring elements, but the driving means 15 can be differently designed and will not be described in more detail. The loading of a dish holder 3 into a dishwasher can thus take place fully without using any movable parts in the dishwasher, which means less wear on these parts than if they were placed in the dishwasher. These moving parts are thus also easily accessible for maintenance and the like. Then washing and discharge of the dish holder takes place with the aid of correspondingly acting driving means being arranged on the corresponding traveller 5*a* on the outlet side. Then the dish holder 3 is conveyed to the unloading place 2*a* by means of a conveying device of the type described above. After unloading, the empty dish holder 3 is placed on the return conveyor 12 by means of e.g. the trolley 14, the dish holder then being returned to the inlet side for loading of new goods to be washed. At the final end of the return conveyor 12 a stop means is arranged, which corresponds to the stop means 16 and which is adapted to prevent further motion of the trolleys until said stop means is released. When this stop means is released, for example a dish holder can be transferred immediately to an associated trolley 13, whereupon the stop means again prevents subsequent dish holders from being further advanced. The dish holder arranged on the trolley can then be moved to the loading place 2, whereupon the entire procedure can be repeated.

The washing installation described above is controlled as follows. The loading device on the inlet side is controlled by a first control unit, the unloading device on the outlet side is controlled by a second control unit, and the dishwashers are controlled separately and by means of a joint third control unit. The control units are quite independent of each other. In this example, transfer of loaded trolleys takes place between the loading place 2 and the storage place 4, and the belt conveyors 4', 4" continuously feed dish holders to said stop means 16 without stopping. The release of the stopping means 16 is controlled by the position of the traveller 5. When the traveller 5 is moved towards its first position, a sensor is pressed in, which, when completely pressed in, when the traveller 5 is in its first position, causes the control unit on the inlet side 10 to emit a release signal to the stop means 16, which is released, and a dish holder 3 is advanced to the traveller 5. Correspondingly, a sensor is arranged on the traveller 5, which after complete transfer of the dish holder 3 to the traveller 5 emits a signal to the control unit on the inlet side 10 that the traveller 5 is prepared to be displaced along the tracks 6, 7. When a dishwasher is free, it emits a signal to the joint third control system, and the signal is forwarded to the first control system. If the traveller is in the standby position described above, the motor 8 starts its displacement motion of the traveller 5 along the tracks 6, 7 to a position where the traveller 5 is located in front of said free dishwasher. A sensor senses that the traveller 5 is located in a feeding position, in which the input door of the dishwasher is opened, whereupon the dish holder is loaded into the dishwasher. When the loading of the dish holder 3 into the dishwasher is terminated, a corresponding sensor in the dishwasher emits a signal for closing the input door, whereupon washing takes place. A washing program is selected by, for example, sensing the location of coding cylinders or the like arranged on the dish holder 3, but this is per se not relevant for the invention and will not be described in more detail. When unloading and transporting the dish holder 3 on the outlet side 11, corresponding sensor transfers take place and will therefore not be described here. The principle is that a mechanical motion of a part of the system by means of sensing starts the next step. The sensors can be configured in many different ways and will not be described in more detail. The advantages of separate control units, and sensors connecting therebetween, are that this construction allows ordinary use of parts of the system when one or more control units stand still. It may be mentioned, for instance, that a dish holder 3 on the inlet side 10 can be loaded manually into a free dishwasher when servicing e.g. the inlet traveller 5, without affecting the automatic discharge on the outlet side 11. In the same way, one or more dishwashers can be put out of operation without affecting the function of the installation in its entirety. Moreover, the order forming in the above storage place 4 can be skipped by manually loading a dish holder 3 into a free dishwasher.

The motor unit 8 is further provided with a safety stop, which stops the motor from displacing the traveller 5 when the traveller is subjected to lateral loads, exerted by e.g. an individual. This prevents, inter alia, injuries caused by squeezing.

Further advantages of the installation are that the free space in front of the dishwashers 1*a*–1*f* allows easy access for service and maintenance thereof. Cleaning of floor surfaces included in the installation is also facilitated, which promotes a hygienic installation. Thanks to the automatic loading and unloading of the dishwashers, the capacity of the installation can also be easily maximised.

A method for loading and feeding by means of a loading system and a washing installation as described above is essentially carried out as follows placing of goods to be washed on a dish holder 3 intended for washing said goods, in a loading place 2, transferring said dish holder 3 from a loading place 2 to a storage place 4, whereupon the dish holder 3 by means of a belt conveyor 4', 4" successively is advanced to a stop means 16, whereupon the advancing optionally is temporarily interrupted, optionally releasing said stop means 16, when a traveller 5 is located in a first position, whereupon the dish holder 3 is transferred from said storage place 4 to the traveller 5, by continued feeding by means of the belt conveyor 4', 4" and/or with the aid of driving means 15 arranged on the traveller, transporting said traveller 5 and the dish holder 3 arranged thereon transversely of the feeding direction of the dishwasher 1*b*, to a feeding position, located in connection with the inlet of the dishwasher 1*b*, whereupon the traveller 5 is made to release opening of the input door of the dishwasher 1*b*, and the driving means 15 on the traveller 5 is made to convey said dish holder 3 into the washing area of the dishwasher 1*b*, whereupon the door is closed, washing of goods placed on said dish holder 3, according to a selected washing program, opening the output door of the dishwasher 1*b* when the washing program is terminated, corresponding driving means 15 on an outlet traveller 5*a* moving said dish holder 3 from the washing area to the outlet traveller 5*a*, the traveller 5*a* being made to transport the dish holder 3 to a corresponding first position and the output door being closed, whereupon the dishwasher 1*b* is prepared to receive a new dish holder, transferring said dish holder 3 to a corresponding storage place 4*a*, and from the storage place 4*a* to an unloading place 2*a*, in which the washed goods are unloaded from the dish holder 3, and placing the empty dish holder 3 on a return conveyor 12 for returning the dish holder 3 to the loading place 12, for use in washing other goods.

It will be appreciated that many modifications of the embodiments of the invention described above are feasible within the scope of the invention as defined by the appended claims. For instance, the driving means described above can be designed in different ways, for transfer motions of the dish holder 3. This also applies to the above-mentioned sensor. Moreover, the travelling track 6 and the supporting track 7 can be of different designs, with rails etc., and besides the location thereof relative to the dishwashers 1*a*–1*f* is not decisive of the invention. For example, both the travelling and the supporting rail 6 and 7 can be arranged above said row of dishwashers 1*a*–1*f*, in which case the traveller hangs freely below the same. Moreover, the storage place 4 can be of different designs and sizes and be dimensioned for the size of the installation. The number of belt conveyors 4', 4" and the location thereof can also be allowed to vary. In spite of the fact that the conveyors 4', 4" described above are belt conveyors, it is possible to replace them by other types of conveyors. However, belt conveyors are preferred for hygienic reasons since they are easy to clean. The storage place can also comprise a collecting tub located under dish holders placed in the storage place, and an outlet connected thereto for easy draining when cleaning the storage place. For instance, also transfer of dish holders to the traveller or opening of dishwasher doors can take place on other occasions than those described above. The design and location of the loading places are variable in order to optimally adapt the configuration of the installation to an existing building. It may finally be mentioned that the design of the installation as such is very flexible. For example, the number of dishwashers, the speed of the traveller, the size of the storage place, the number of dish holders included in the system, the length of the return conveyor and the above-mentioned loading places can be varied in order to optimally adapt the installation to a client's requirements, and an installation according to the invention may also comprise merely a loading device or an unloading device, in which case unloading or loading occurs manually, or with the aid of other automatic means.

What is claimed is:

1. A loading system in a washing installation, said installation comprising a plurality of dishwashers arranged essentially in parallel with respective inlets arranged essentially side by side along a line which extends transversely to a feeding direction through said inlets, said loading system comprising:

a dish holder to be loaded with goods to be washed, and a traveller which is adapted to convey said dish holder in front of a selected dishwasher, into which loading is to take place, said traveller being displaceably arranged along said line of inlets.

2. The loading system as claimed in claim 1, further comprising a storage for intermediate storage of loaded dish holders.

3. The loading system as claimed in claim 2, further comprising at least one loading place for loading of goods to be washed onto the dish holder included in said washing installation or unloading of washed goods from said dish holder.

4. The loading system as claimed in claim 1, further comprising at least one loading place for loading of goods to be washed onto the dish holder included in said washing installation or unloading of washed goods from said dish holder.

5. The loading system as claimed in claim 1, wherein said traveller is, at a top, displaceably supported by a travelling track extending above said dishwashers arranged in parallel.

6. The loading system as claimed in claim 5, wherein the traveller comprises a motor unit for moving the traveller and said motor unit is arranged in connection with said travelling track.

7. The loading system as claimed in claim 6, wherein said motor unit is provided with a safety stop which is adapted to stop the motor unit and, thus, further movement of the traveller in case of unintentional load being exerted on said traveller, thereby preventing injuries caused by squeezing.

8. The loading system as claimed in claim 1, wherein said traveller is, at a top, pendular-supported, said traveller in a lower part resting against a supporting track extending below said dishwashers arranged in parallel.

9. The loading system as claimed in claim 1, wherein said traveller clears the floor of the installation.

10. The loading system as claimed in claim 1, wherein said traveller is displaceable in a direction essentially perpendicular to a feeding direction of the dishwashers.

11. The loading system as claimed in claim 1, wherein driving means are arranged on said traveller for transferring the dish holder between said traveller and a washing space of the associated dishwasher when the traveller is in a feeding position.

12. The loading system as claimed in claim 1, wherein the traveller comprises a motor unit for moving the traveller.

13. The loading system as claimed in claim 12, wherein said motor unit is provided with a safety stop which is adapted to stop the motor unit and, thus, further movement of the traveller in case of unintentional load being exerted on said traveller, thereby preventing injuries caused by squeezing.

14. A loading system in a washing installation, said installation comprising a plurality of dishwashers arranged essentially in parallel, said loading system comprising:

a dish holder to be loaded with goods to be washed, and a traveller which is adapted to convey said dish holder to a selected dishwasher, into which loading is to take place, said traveller being displaceably arranged along said dishwashers arranged in parallel, wherein said traveller is movable between a first position, in which the dish holder is movable between the traveller and a storage place, and a number of feeding positions which are located in connection with an inlet/outlet of the respective dishwashers and in which the dish holder is movable between the traveller and the washing space of the respective dishwashers, the dish holder arranged on the traveller being stationary relative to said traveller during the motion of the traveller between the first position and one of said feeding positions.

15. The loading system as claimed in claim 14, wherein said storage place is adapted to store a plurality of dish holders which are oriented in advance in a same direction as in a washing operation, and comprises a belt conveyor extending in a feeding direction and adapted to successively convey the dish holders between a first transfer position for transferring the dish holders between the storage place and said traveller when the traveller is located in said first position, and a second transfer position for transferring the dish holders between a loading place and the storage place, said storage place accommodating the plurality of dish holders.

16. A washing installation comprising:

a plurality of dishwashers arranged essentially in parallel and being of a straightway type, said dishwashers being essentially built into a separating wall portion to form an inlet side and an outlet side, two mutually independent loading systems for loading of goods to be washed on the inlet side and unloading of washed goods on the outlet side each loading system including a dish holder to be loaded with goods to be washed, and a traveller which is adapted to convey said dish holder to a selected dishwasher, into which loading is to take place, said traveller being displaceably arranged along said dishwashers arranged in parallel.

17. The washing installation as claimed in claim 16, further comprising a return conveyor which travels from the outlet side to the inlet side for returning free dish holders to a loading place on the inlet side.

18. The washing installation as claimed in claim 17, wherein the loading system on the inlet side, the unloading system on the outlet side and the dishwashers are controlled separately from each other by means of independent control units, and comprises, for synchronisation between the three subsystems, mechanical sensors which are electrically connected to the respective control units.

19. The washing installation as claimed in claim 17, further comprising a trolley on at least one of the inlet side and the outlet side, which is movable between a return conveyor and a storage place on the respective side and is adapted to transfer the dish holder between said trolley and the return conveyor and the storage place, respectively.

20. The washing installation as claimed in claim 16, wherein the loading system on the inlet side, the unloading system on the outlet side and the dishwashers are controlled separately from each other by means of independent control units, and comprises, for synchronisation between the three subsystems, mechanical sensors which are electrically connected to the respective control units.

21. The washing installation as claimed in claim 20, further comprising a trolley on at least one of the inlet side and the outlet side, which is movable between a return conveyor and a storage place on the respective side and is adapted to transfer the dish holder between said trolley and the return conveyor and the storage place, respectively.

22. The washing installation as claimed in claim 16, further comprising a trolley on at least one of the inlet side and the outlet side, which is movable between a return conveyor and a storage place on the respective side and is adapted to transfer the dish holder between said trolley and the return conveyor and the storage place, respectively.

23. A method for loading one of a plurality of dishwashers arranged in parallel with respective inlets arranged essentially side by side along a line which extends transversely to a feeding direction through said inlets, comprising the steps of:

placing goods to be washed on a dish holder intended for washing said goods, placing said dish holder on a traveller, and moving said traveller and the dish holder arranged thereon transversely of a feeding direction of the dishwashers in front of a selected dishwasher.

* * * * *